US007604553B2

(12) United States Patent
Shinohara

(10) Patent No.: US 7,604,553 B2
(45) Date of Patent: Oct. 20, 2009

(54) GOLF BALL

(75) Inventor: Hirotaka Shinohara, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/934,335

(22) Filed: Nov. 2, 2007

(65) Prior Publication Data

US 2009/0118039 A1 May 7, 2009

(51) Int. Cl.
*A63B 37/06* (2006.01)

(52) U.S. Cl. ..... 473/378

(58) Field of Classification Search ..... 473/378, 473/383, 384

See application file for complete search history.

(56) References Cited

U.S. PATENT DOCUMENTS

| | | | | |
|---|---|---|---|---|
| 5,711,723 | A | 1/1998 | Hiraoka et al. | |
| 5,772,531 | A | 6/1998 | Ohsumi et al. | |
| 5,816,937 | A | 10/1998 | Shimosaka et al. | |
| 6,045,460 | A | 4/2000 | Hayashi et al. | |
| 6,123,630 | A | 9/2000 | Hayashi et al. | |
| 6,194,505 | B1 | 2/2001 | Sone et al. | |
| 6,231,461 | B1 | 5/2001 | Moriyama et al. | |
| 6,248,027 | B1 | 6/2001 | Hayashi et al. | |
| 6,336,870 | B1 * | 1/2002 | Kato et al. | 473/351 |
| 6,416,425 | B1 | 7/2002 | Maruko et al. | |
| 6,468,169 | B1 | 10/2002 | Hayashi et al. | |
| 6,527,652 | B1 | 3/2003 | Maruko et al. | |
| 6,561,923 | B1 | 5/2003 | Ohama et al. | |
| 6,642,314 | B2 | 11/2003 | Sone et al. | |
| 6,676,543 | B2 | 1/2004 | Endo | |
| 6,716,166 | B2 | 4/2004 | Govari | |
| 6,793,593 | B2 | 9/2004 | Binette et al. | |
| 6,981,925 | B2 | 1/2006 | Shimizu et al. | |
| 7,128,665 | B2 | 10/2006 | Fushihara | |
| 7,267,623 | B2 | 9/2007 | Manami et al. | |
| 7,294,680 | B2 | 11/2007 | Sone et al. | |
| 2006/0128504 | A1 * | 6/2006 | Watanabe et al. | 473/371 |

FOREIGN PATENT DOCUMENTS

| | | | |
|---|---|---|---|
| JP | 06-254180 | A | 9/1994 |
| JP | 07-051403 | A | 2/1995 |
| JP | 07-059879 | A | 3/1995 |
| JP | 08-332247 | A | 12/1996 |
| JP | 09-248351 | A | 9/1997 |
| JP | 10-127818 | A | 5/1998 |
| JP | 10-127819 | A | 5/1998 |
| JP | 10-295852 | A | 11/1998 |
| JP | 10-325327 | A | 12/1998 |
| JP | 10-325328 | A | 12/1998 |
| JP | 10-328325 | A | 12/1998 |
| JP | 10-328326 | A | 12/1998 |
| JP | 11-004916 | A | 1/1999 |
| JP | 11-035633 | A | 2/1999 |
| JP | 11-164912 | A | 6/1999 |
| JP | 11-216200 | A | 8/1999 |
| JP | 2000-024136 | A | 1/2000 |

(Continued)

*Primary Examiner*—Raeann Trimiew
(74) *Attorney, Agent, or Firm*—Sughrue Mion, PLLC

(57) ABSTRACT

The present invention relates to a golf ball having a core, a cover of at least one layer encasing the core, and a surface on which a plurality of dimples are formed. The cover has an outermost layer with a thickness of at least 1.2 mm and a Shore D hardness of at least 50 but not more than 65. The ball surface has a lightness L value, expressed in the Lab color system as defined by JIS Z8730, of at least 89, an a value of at least 2 but not more than 10, and a b value of −20 or above. Increasing the reddish coloring of a white golf ball enhances the fashionability of the ball and improves the way the ball looks and feels to the golfer when it is played.

16 Claims, 1 Drawing Sheet

FOREIGN PATENT DOCUMENTS

Figure 1:
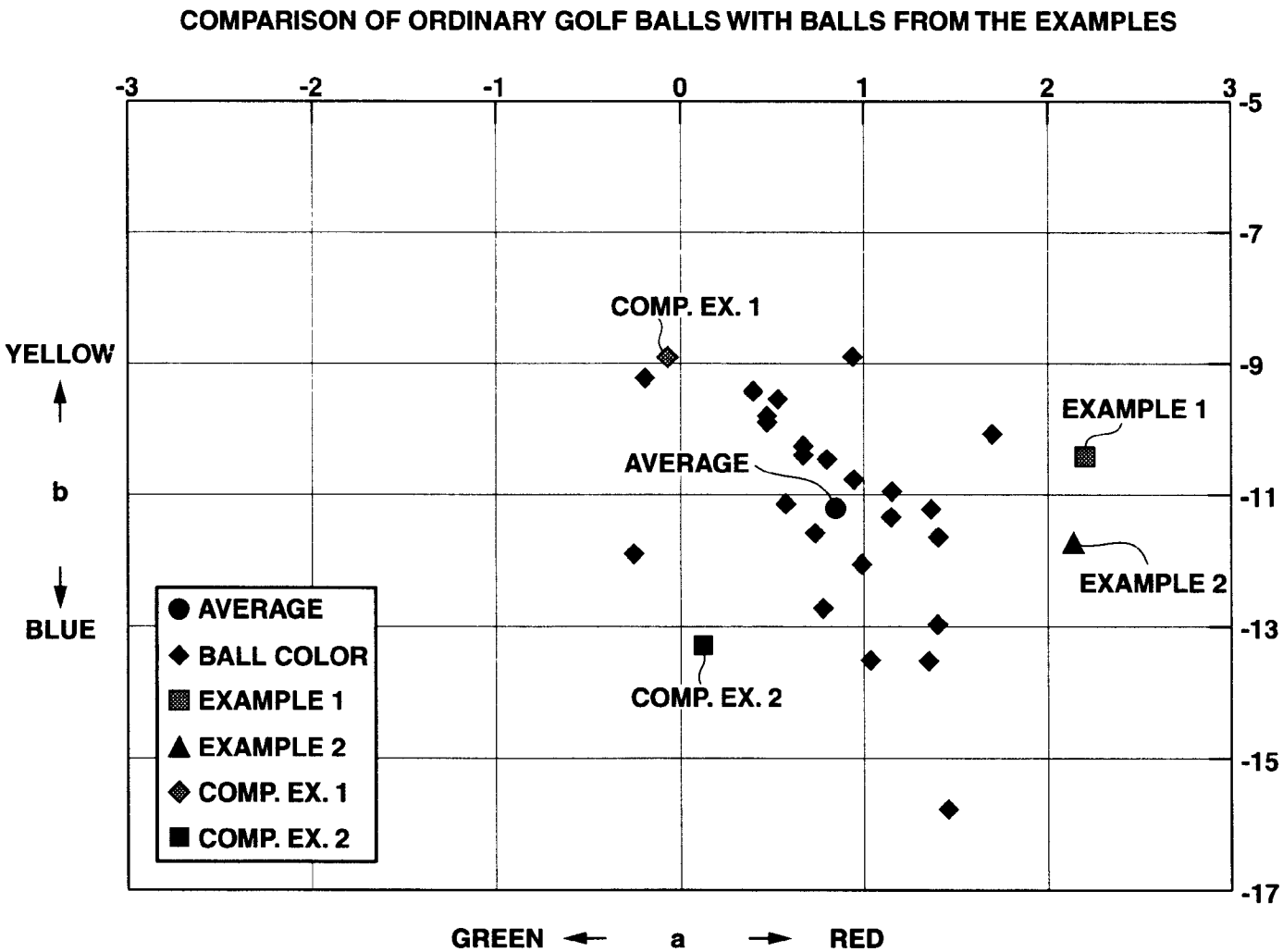

| | | | |
|---|---|---|---|
| JP | 2001-017576 | A | 1/2001 |
| JP | 2001-037914 | A | 2/2001 |
| JP | 2002-126132 | A | 5/2002 |
| JP | 2002-136621 | A | 5/2002 |
| JP | 2002-293996 | A | 10/2002 |
| JP | 2004-180822 | A | 7/2004 |
| JP | 2007-13670 | A | 6/2007 |

* cited by examiner

GOLF BALL

BACKGROUND OF THE INVENTION

The present invention relates to a golf ball which is a white ball tinged with red, and is endowed with both fashionability and a quality feel.

Conventional white golf balls have a strongly yellowish or bluish cast. To date, there have been no golf balls which are entirely satisfactory both in terms of fashionability and how the ball looks and feels to the golfer.

Generally, even when the shape and size of the design are the same, the way in which the size and hardness of a golf ball are perceived can vary significantly depending on the coloration of the cover. Hence, it is desirable to adjust such coloration from the viewpoint of the golfer.

Conventional blue golf balls include those disclosed in JP-A 11-216200, JP-A 07-059879, JP-A 07-051403, JP-A 06-254180, JP-A 2001-017576, JP-A 2002-126132 and JP-A 2007-136170. These golf balls have a strongly bluish coloring, which often makes them feel colder and harder. The distance traveled by a golf ball generally tends to decrease under low temperature conditions. Hence, a ball that feels colder and harder often disrupts the golfer's swing.

Golf balls having a yellowish coloring like that disclosed in JP-A 2002-136621 often appear to have yellowed, making them seem old and lacking in fashionability, which is undesirable in terms of appearance.

The golf ball described in JP-A 2000-024139 is a colored golf ball having a strong pink or orange coloring. Such golf balls differ markedly from ordinary golf balls in their brightness and sense of quality.

SUMMARY OF THE INVENTION

It is therefore an object of the present invention to provide a golf ball which, in spite of being a white ball, has a high quality feel to it and fashionability, giving it a high commercial value, which has an apparent hardness that substantially agrees with the actual ball hardness, and, which can be comfortably played because it feels "right" to the golfer at the time of impact.

As a result of extensive investigations aimed at achieving the above object, the inventor has discovered that by intensifying the red hue in a white golf ball, the appearance of the golf ball is changed and the way the ball looks and feels to the golfer when played can be improved.

Accordingly, the invention provides the following golf balls.

[1]A golf ball comprising a core, a cover of at least one layer encasing the core and a surface on which a plurality of dimples are formed, wherein the cover has an outermost layer with a thickness of at least 1.2 mm and a Shore D hardness of at least 50 but not more than 65, and wherein the ball surface has a lightness L value, expressed in the Lab color system defined by JIS Z8730, of at least 89, an a value of at least 2 but not more than 10, and a b value of −20 or above.

[2] The golf ball of [1], wherein the outermost layer comprises 100 parts by weight of a base resin, from 1 to 7 parts by weight of titanium oxide, from 0.001 to 0.5 part by weight of a blue pigment, and at least 0.006 part by weight of a red pigment.

[3] The golf ball of [1], wherein the outermost layer is coated with a clear urethane coating.

[4] The golf ball of [1], wherein the number of dimples formed on the ball surface is from 250 to 500 and the ball, when hit, has a coefficient of lift CL at a Reynolds number of 70,000 and a spin rate of 2,000 rpm that is at least 0.165, and a coefficient of drag CD at a Reynolds number of 180,000 and a spin rate of 2,520 rpm that is at most 0.230.

The tendency with colors is for the lightness of a color to relate strongly to the way in which size, hardness and weight are perceived. At the same degree of lightness, a warm color makes an object appear larger than does a cold color. Compared with the actual hardness and weight of a colored object, cold colors give an impression of greater hardness and weight that do warm colors. Therefore, in the present invention, by intensifying the reddish (warm) coloring and selecting a suitable lightness value, there is provided a golf ball which has a suitable look and feel to the golfer before being played and on which the design and other markings are fully and effortlessly visible.

BRIEF DESCRIPTION OF THE DIAGRAM

FIG. 1 is compares ordinary golf balls with balls from the examples in a ball color system.

DETAILED DESCRIPTION OF THE INVENTION

The invention is described more fully below.

The present invention provides a golf ball having a core and a cover of at least one layer encasing the core. A plurality of dimples are formed on the surface of the ball.

The core material, which is not subject to any particular limitation, may be made of a known rubber composition. For example, rubber compositions formulated from a base rubber (e.g., polybutadiene), a co-crosslinking agent (e.g., unsaturated carboxylic acids and metal salts thereof), an inorganic filler (e.g., zinc oxide, barium sulfate, calcium carbonate, titanium oxide), and an organic peroxide (e.g., dicumyl peroxide, 1,1-bis(t-butylperoxy)cyclohexane) may be used. If necessary, other ingredients such as commercial antioxidants may also be included as appropriate.

The present invention relates to a white golf ball having a strong reddish coloring, which ball is characterized in that the ball surface has a lightness L value, expressed in the Lab color system defined by JIS Z8730, of at least 89, an a value of at least 2 but not more than 10, and a b value of at least −20 but not more than 0.

The Lab color system used herein is determined from the following formulas using the tristimulus values X, Y and Z specified in JIS Z8730.

$$L=10Y^{1/2} \quad (1)$$

$$a=17.5(1.02X-Y)/Y^{1/2} \quad (2)$$

$$b=7.0(Y-0.847Z)/Y^{1/2} \quad (3)$$

where L: lightness index in R.S. Hunter's color difference equations a, b: color coordinates in Hunter's color difference equations X, Y, Z: tristimulus values X, Y and Z in XYZ color system In the above Lab color system, L represents lightness and is determined as a value from 100 to 0. "Lightness" refers to the light or dark state of a color; that is, to the degree of luminance. A larger L value signifies greater lightness.

The a and b values indicate perceived color, with the a value representing the red-green direction and the b value representing the yellow-blue direction. A higher a value indicates more intense redness, and a lower a indicates more intense greenness. A higher b value indicates more intense yellowness, and a lower b value indicates more intense blueness. The relationship between these a and b values is summarized in Table 1 below.

TABLE 1

| b | a: Negative (−) | Close to zero | Positive (+) |
|---|---|---|---|
| Negative (−) | blue | blue-violet | violet |
| Close to zero | green | white/gray/black | red-violet |
| Positive (+) | blue-green | yellow | red |

Generally, in commercially sold white golf balls, the L value is about 90 to 93, the a value is about 0.8, and the b value is about −11. FIG. 1 shows a diagram comparing ordinary commercial golf balls with golf balls from the subsequently described examples according to the invention.

In the present invention, the surface of the golf ball has an L value (lightness) of at least 89, preferably at least 90, and even more preferably at least 91. If this value is too low, the ball will appear relatively small, which may disrupt the golfer's swing.

The a value is at least 2.0, and preferably at least 2.1. At an a value smaller than that the above value, it is not possible to fully achieve both fashionability and the desired look and feel of the ball to the golfer when it is played. The upper limit in the a value is not more than 10, and preferably not more than 5.

In the present invention, to further accentuate the high quality feel of the golf ball, it is critical for the b value to have a lower limit of −20 or above, and preferably −18 or above. The upper limit value, while not subject to any particular limitation, is preferably 0 or below, and more preferably −5 or below.

By adjusting the b value in the above manner, the golf ball degree of whiteness can be suitably adjusted, enabling the high quality feel of the golf ball to be enhanced.

The yellow index (YI) of the inventive golf ball is preferably −30 or above, and more preferably −25 or above, but preferably not above −10, and more preferably not above −15. Expressing the yellow index (YI) as a negative value indicates that the color moves in the blue direction. The yellow index may be determined by measuring the tristimulus values X, Y and Z using a color difference meter, then inserting the values into the following formula.

$$YI=100(1.28X-1.06Z)/Y$$

Next, the cover used in the golf ball of the invention is described. The cover is not limited to one layer, and may be formed of a plurality of two or more layers. It is critical for the cover to have an outermost layer with a thickness of at least 1.2 mm and a Shore D hardness of at least 50 but not more than 65.

The respective layers of the cover (including the outermost layer) have a thickness of preferably at least 1.2 mm, more preferably at least 1.8 mm, even more preferably at least 1.9 mm, and most preferably at least 2.0 mm, but preferably not more than 2.3 mm, more preferably not more than 2.2 mm, and even more preferably not more than 2.1 mm. If the respective cover layers have thicknesses higher than the above range, the ball rebound may decrease, as a result of which the ball may not travel as far as desired. On the other hand, if the respective cover layers have thicknesses lower than the above range, the durability of the ball to repeated impact may decrease.

The respective layers of the cover have Shore D hardnesses of preferably at least 50, more preferably at least 55, and even more preferably at least 58, but preferably not more than 65, more preferably not more than 63, and even more preferably not more than 60. If the Shore D hardnesses of the respective layers are harder than the above range, the durability of the ball to repeated impact may decrease and the ball may have too hard a feel on impact. On the other hand, if the cover layers are too soft, the ball may have a lower rebound and a higher spin rate, resulting in a shorter distance.

In order for the surface color of the inventive golf ball to fall within the above-indicated range, it is preferable for the material making up the outermost layer to include 100 parts by weight of the base resin, from 1 to 7 parts by weight of titanium oxide, from 0.001 to 0.5 part by weight of a blue pigment, and at least 0.006 part by weight of a red pigment.

The base resin of the cover material used in the invention may be any type of thermoplastic resin. The primary ingredient of the cover base resin may be at least one or a mixture of two or more selected from among thermoplastic resins and thermoplastic elastomers. More specifically, preferred use may be made of at one or more selected from among thermoplastic block copolymers, polyester elastomers, polyamide elastomers, polyurethane elastomers and ionomer resins. Ionomer resins and polyurethane elastomers are preferred. The use of an ionomer resin is especially preferred because such resins undergo less discoloration due to deterioration over time than do polyurethane elastomers.

The above-mentioned titanium oxide is titanium white. The titanium white used may be rutile or anatase. These may be manufactured by a suitable process such as the sulfate process or the chloride process, and may be surface treated with hydrous oxides of aluminum and silicon. Using a surface-treated titanium oxide enhances dispersibility in the base resin, and is thus preferred. Use can also be made of, for example, ultrafine titanium oxide particles (particle size, 0.02 to 0.05 μm), high-purity titanium oxide, and titanium oxide needles (fiber diameter, 0.05 to 0.15 μm; fiber length, 3 to 12 μm).

In the practice of the invention, titanium oxide, blue pigment and red pigment may be included in the cover base resin. Titanium oxide is included in an amount of preferably from 1 to 7 parts by weight, and more preferably from 2 to 5 parts by weight, per 100 parts by weight of the base resin. If less than 1 part by weight of titanium oxide is included, there will be a lack of hiding power and the desired titanium color will be impossible to achieve. On the other hand, at more than 7 parts by weight, the golf ball will have a strong yellow coloring that makes it look old and may thus lack fashionability.

Preferred examples of the red pigment used in the invention include inorganic pigments such as red iron oxide (hematite) and red lead oxide, and organic pigments such as quinacridone magenta, permanent red and perylene red. The use of permanent red is especially preferred.

The golf ball of the invention contains preferably at least 0.006 part by weight, more preferably at least 0.008 part by weight, and even more preferably at least 0.010 part by weight, of red pigment per 100 parts by weight of the cover base resin. The upper limit in the amount of red pigment contained is preferably not more than 0.05 part by weight, more preferably not more than 0.04 part by weight, and even more preferably not more than 0.03 part by weight. If too much red pigment is included, the color of the golf ball itself will darken, not only making the ball appear smaller, but also possibly resulting in a loss of fashionability.

With the use of a golf ball featuring a red pigment, a white color having a strong yellow tinge results, making it difficult to fully achieve both fashionability and a high quality feel in the ball. To this end, in the practice of the present invention, a blue pigment may be used within a range that does not compromise the effects of the invention.

Preferred examples of blue pigments that may be used include inorganic pigments such as ultramarine blue, cobalt blue and Prussian blue, and organic pigments such as phthalocyanine blue, alkali blue and indanthrone blue. The use of ultramarine blue is especially preferred. The blue pigment is included in an amount of preferably at least 0.001 part by weight, more preferably at least 0.005 part by weight, and even more preferably at least 0.01 part by weight, per 100 parts by weight of the cover base resin. The upper limit in the amount of the blue pigment included per 100 parts by weight of the cover base resin is preferably not more than 0.5 part by weight, more preferably not more than 0.3 part by weight, and even more preferably not more than 0.1 part by weight.

In addition, violet pigments and yellow pigments may be suitably included to a degree that does not result in a loss of the reddish coloring by the red pigment included in the invention. The lower limit in the amount of such additional pigments may be set to at least 0.001 part by weight, preferably at least 0.005 part by weight, and more preferably at least 0.01 part by weight. The upper limit in the amount of such additional pigments included is preferably not more than 0.5 part by weight, and more preferably not more than 0.1 part by weight. By including suitable amounts of the above-described blue pigment, violet pigment and yellow pigment, the fashionability and high quality feel of the inventive golf ball can be enhanced. However, blue, violet and yellow pigments are not necessarily essential for achieving the objects of the invention. Including such pigments in amounts outside of the above range is not desirable as the resulting golf ball may appear yellowish or darker.

If necessary, various thermoplastic elastomers and various additives, such as low-molecular-weight polyethylene wax, may be included within a range that does not compromise the clarity of the cover resin material.

A fluorescent whitener may be included in the resin material for the cover. The amount of fluorescent whitener included per 100 parts by weight of the cover resin material is typically from 0.01 to 0.5 part by weight, preferably from 0.03 to 0.3 part by weight, and more preferably from 0.05 to 0.1 part by weight. By using a fluorescent whitener in an amount within the above range, the L value can be increased, thereby enabling the fashionability and high quality feel of the ball to be enhanced.

Numerous dimples may be formed on the surface of the cover. The dimples arranged on the cover surface generally number from 250 to 500, preferably from 300 to 360, and more preferably from 325 to 340. If the number of dimples is higher than the above range, the ball will tend to have a low trajectory, which may shorten the distance of travel. On the other hand, if the number of dimples is too small, the ball will tend to have a high trajectory, as a result of which an increased distance may not be achieved. Any one or combination of two or more dimple shapes, including circular shapes, various polygonal shapes, dewdrop shapes and oval shapes, may be suitably used. If circular dimples are used, the diameter of the dimples may be set to from 2.0 to 6.5 mm, and the depth may be set to from 0.08 mm to 0.30 mm. Moreover, the dimples may be suitably selected so as to set the value $V_0$ (the value obtained by dividing the spatial volume of each dimple below the flat plane circumscribed by the edge of that dimple by the volume of a cylinder whose base is the flat plane and whose height is the maximum depth of the dimple from the cylinder base) in a range of from 0.35 to 0.80, the value SR (the sum of the individual dimple surface areas, each defined by the border of the flat plane circumscribed by the edge of the dimple, expressed as a ratio with respect to the spherical surface area of the ball were it to be free of dimples) in a range of from 60 to 90%, and the value VR (the sum of the volumes of individual dimples formed below flat planes circumscribed by the dimple edges, as a percentage of the volume of the ball sphere were it to have no dimples thereon) in a range of from 0.6 to 1. Outside of these ranges, the ball may assume a trajectory that is not conducive to achieving a good distance, as a result of which the ball may fail to travel a sufficient distance when played.

The above dimples are features that form numerous raised and recessed areas on the ball surface. The diameter, number and depth of the dimples exert an influence on the appearance of the ball. Accordingly, it is preferable for the dimples to be configured in such a way as to allow the objects of the invention to be achieved. For example, if the number of dimples is too high, when light strikes the ball, the visibility of the colored ball may be diminished. That is, depending on the angle at which the ball is seen, shadows may form at the bottoms of the dimples, making the ball appear darker. Conversely, if the number of dimples is too low, when the ball is struck, the desired aerodynamic characteristics cannot be achieved, as a result of which the ball may not travel as far as desired.

To increase the distance traveled by a golf ball, it is regarded as desirable for the ball to have a low coefficient of drag CD at high velocity and a high coefficient of lift CL at low velocity. Hence, the golf ball of the invention has a low-velocity CL, which is the coefficient of lift on the ball just after being launched with an Ultra Ball Launcher (UBL) when measured at a Reynolds number of 70,000 and a spin rate of 2,000 rpm, of preferably at least 0.165, more preferably at least 0.170, and even more preferably at least 0.180. The inventive golf ball has a high-velocity CD, which is the coefficient of drag on the ball just after launch at a Reynolds number of 180,000 and a spin rate of 2,520 rpm, of preferably not more than 0.230, more preferably not more than 0.225, and even more preferably not more than 0.220. Outside of these ranges, the golf ball may not be able to achieve a good distance.

In the practice of the invention, any of various coatings may be applied to the surface of the golf ball cover. Given the need to withstand the demanding conditions of golf ball use, preferred examples include two-part curing urethane coatings, particularly non-yellowing urethane coatings.

The ball has a deflection, expressed as the deformation of the ball when compressed under a final load of 1,275 N (130 kgf) from an initial load of 98 N (10 kgf), of generally from 2.0 to 5.0 mm, preferably from 2.5 to 4.0 mm, and more preferably from 3.0 mm to 3.7 mm. If the deformation is too small, the feel on impact may be too hard and the period of contact between the ball and the club face may be too short, which tends to result in a poor controllability. On the other hand, if the deformation is too large, the feel on impact may be too soft and the ball may have a poor durability to cracking on repeated impact.

The inventive golf ball may be manufactured by a method which involves vulcanizing a rubber composition composed primarily of polybutadiene under known vulcanization conditions to form a molded and crosslinked rubber material (core), then forming a cover over the core by a known process such as injection molding.

The golf ball of the invention, which can be manufactured so as to conform with the Rules of Golf for competitive play, may be produced to a ball diameter which is not less than 42.67 mm and to a weight which is not more than 45.93 g.

As described above, in the golf ball of the invention, the reddish coloring of a white golf ball has been intensified, thereby enhancing the fashionability of the ball and also improving the way the ball looks and feels to the golfer when it is played.

EXAMPLES

The following Examples of the invention and Comparative Examples illustrate but do not limit the invention.

Examples 1 to 2, Comparative Examples 1 to 2

A rubber composition common to all the examples of the invention and the comparative examples was prepared, then masticated with a kneader or a roll mill, following which cores were fabricated under specific vulcanization conditions. The cover resin materials shown in Table 2 were then injection-molded over the core in a mold, thereby giving solid two-piece golf balls according to the respective examples of the invention and comparative examples.

TABLE 2

| | | Example | | Comparative Example | |
|---|---|---|---|---|---|
| | | 1 | 2 | 1 | 2 |
| Cover formulation (pbw) | Himilan 1601 | 50 | 50 | 50 | 50 |
| | Himilan 1557 | 50 | 50 | 50 | 50 |
| | Titanium oxide | 4.2 | 4.1 | 4.2 | 4.2 |
| | Blue pigment | 0.052 | 0.07 | 0.052 | 0.122 |
| | Violet pigment | 0.046 | | | |
| | Red pigment | 0.012 | 0.007 | | |
| | Magnesium stearate | 0.3 | 0.4 | 0.3 | 0.3 |
| | Low-molecular-weight polyethylene wax | 0.1 | | 0.1 | 0.1 |
| | Fluorescent whitener | | 0.05 | | |
| Cover material hardness (Shore D) | | 55 | 55 | 55 | 55 |
| Cover thickness (mm) | | 1.7 | 1.7 | 1.7 | 1.7 |
| Type of color | | reddish white | reddish white | yellowish white | bluish white |
| Ball color | L value | 91.6 | 93.1 | 93.4 | 90.1 |
| | a value | 2.2 | 2.1 | −0.1 | 0.1 |
| | b value | −10.4 | −11.7 | −8.9 | −13.3 |
| | Yellow index (YI) | −18.3 | −20.6 | −16.7 | −26 |
| Ball diameter (mm) | | 42.7 | 42.7 | 42.7 | 42.7 |
| Apparent size | | good | good | fair | NG |
| Apparent hardness | | good | good | good | NG |
| Apparent weight | | good | good | good | NG |
| Fashionability | | good | good | NG | good |

The cover material is described below. Numbers in the table indicate the proportions of the respective ingredients in parts by weight per 100 parts by weight of the resin material.

Himilan (trade name): Ionomer resins produced by DuPont-Mitsui Polychemicals Co., Ltd.

Low-molecular-weight polyethylene wax: Produced by Sanyo Chemical Industries, Ltd. under the trade name "Sanwax 161-P"

The properties of the golf balls obtained in the respective examples of the invention and the comparative examples were evaluated according to the criteria shown below. The results are presented in Table 2.

Color of Ball Surface

The color at the ball surface in the Lab color system was measured using a multiple light source spectrocolorimeter manufactured by Suga Test Instruments Co., Ltd.

Ball Appearance (1) Apparent Size—Sensory evaluations by ten ordinary golfers.
Good: At least seven of the golfers felt the ball was large.
Fair: Six of the golfers felt the ball was large.
NG: Five or fewer of the golfers felt the ball was large.

(2) Apparent Hardness—Sensory evaluations by ten ordinary golfers.
Good: Six or fewer of the golfers felt the ball was hard.
NG: At least seven of the golfers felt the ball was hard.

(3) Apparent Weight—Sensory evaluations by ten ordinary golfers.
Good: Six or fewer of the golfers felt the ball was heavy.
NG: At least seven of the golfers felt the ball was heavy.

(4) Fashionability—Sensory evaluations by ten ordinary golfers.
Good: At least seven of the golfers felt the ball was fashionable.
NG: Six or fewer of the golfers felt the ball was fashionable.

FIG. 1 compares the color levels (a and b values) for the golf balls obtained in the examples of the invention and the comparative examples. In addition, the colors of several ordinary white golf balls are also plotted and their average value is shown. As is apparent from the results shown in Table 1 and from FIG. 1, the golf balls in the examples of the invention, which are white golf balls wherein the reddish coloring has been intensified, have an apparent size, apparent weight and apparent hardness which are all improved. It is thus possible to both avoid disruption in the swing taken by the golfer and at the same time maintain the fashionability of the golf ball.

The invention claimed is:

1. A golf ball comprising a core, a cover of at least one layer encasing the core and a surface on which a plurality of dimples are formed, wherein the cover has an outermost layer with a thickness of at least 1.2 mm and a Shore D hardness of at least 50 but not more than 65, and wherein the ball surface has a lightness L value, expressed in the Lab color system defined by JIS Z8730, of at least 89, an a value of at least 2 but not more than 10, and a b value of −20 or above;

wherein the outermost layer comprises at least 0.006 part by weight of a red pigment per 100 parts by weight of a base resin.

2. The golf ball of claim 1, wherein the outermost layer comprises 100 parts by weight of a base resin, from 1 to 7 parts by weight of titanium oxide, and from 0.001 to 0.5 part by weight of a blue pigment.

3. The golf ball of claim 1, wherein the outermost layer is coated with a clear urethane coating.

4. The golf ball of claim 1, wherein the number of dimples formed on the ball surface is from 250 to 500 and the ball, when hit, has a coefficient of lift CL at a Reynolds number of 70,000 and a spin rate of 2,000 rpm that is at least 0.165, and a coefficient of drag CD at a Reynolds number of 180,000 and a spin rate of 2,520 rpm that is at most 0.230.

5. The golf ball of claim 1, wherein the outermost layer comprises from 0.008 to 0.05 parts by weight of red pigment.

6. The golf ball of claim 1, wherein the outermost layer comprises from 0.010 to 0.04 parts by weight of red pigment.

7. The golf ball of claim 1, wherein the outermost layer comprises from 0.010 to 0.03 parts by weight of red pigment.

8. The golf ball of claim 1, wherein the yellow index YI of the golf ball is from −30 to −10.

9. The golf ball of claim 2, wherein the titanium oxide is surface treated with hydrous oxides of aluminum and silicon.

10. The golf ball of claim 2, wherein the titanium oxide is ultrafine titanium oxide having a particle size of 0.02 to 0.05 μm.

11. The golf ball of claim 2, wherein the titanium oxide is titanium oxide needles having a fiber diameter of 0.05 to 0.15 μm and a fiber length of 3 to 12 μm.

12. The golf ball of claim 1, wherein the red pigment is at least one pigment selected from the group consisting of red iron oxide (hematite), red lead oxide, quinacridone magenta, permanent red and perylene red.

13. The golf ball of claim 1, wherein the outermost layer further comprises from 0.001 to 0.5 parts by weight of a violet pigment per 100 parts by weight of the base resin.

14. The golf ball of claim 1, wherein the outermost layer further comprises from 0.001 to 0.5 parts by weight of a yellow pigment per 100 parts by weight of the base resin.

15. The golf ball of claim 1, wherein the base resin includes from 0.01 to 0.5 parts by weight of a fluorescent whitener per 100 parts by weight of the base resin.

16. The golf ball of claim 1, wherein the weight ratio [(A)/(B)] between the blue pigment (A) and the red pigment (B) added in the outermost layer is from 4.3/1 to 10/1.

* * * * *